US009254646B2

(12) United States Patent
Ito

(10) Patent No.: US 9,254,646 B2
(45) Date of Patent: Feb. 9, 2016

(54) INKJET RECORDING APPARATUS, CONTROL METHOD FOR INKJET RECORDING APPARATUS, AND NON-TRANSITORY COMPUTER-READABLE MEDIUM

(71) Applicant: Daisuke Ito, Kanagawa (JP)

(72) Inventor: Daisuke Ito, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/644,391

(22) Filed: Mar. 11, 2015

(65) Prior Publication Data

US 2015/0258779 A1 Sep. 17, 2015

(30) Foreign Application Priority Data

Mar. 14, 2014 (JP) ..... 2014-052777

(51) Int. Cl.
*B41J 29/38* (2006.01)
*B41J 2/045* (2006.01)

(52) U.S. Cl.
CPC ..... *B41J 2/04573* (2013.01); *B41J 2/04586* (2013.01)

(58) Field of Classification Search
CPC ..... B41J 2/165; B41J 2/1707; B41J 2/1714; B41J 2002/16502; B41J 2002/1657; B41J 2/04541
USPC ..... 347/9, 14, 20, 23, 35
See application file for complete search history.

(56) References Cited

U.S. PATENT DOCUMENTS

| | | | | |
|---|---|---|---|---|
| 7,648,225 | B2 * | 1/2010 | Ishimoto et al. | 347/41 |
| 2006/0061785 | A1 * | 3/2006 | Nagoshi et al. | 358/1.9 |
| 2007/0057981 | A1 * | 3/2007 | Lee et al. | 347/7 |

FOREIGN PATENT DOCUMENTS

| | | |
|---|---|---|
| JP | 2002-113847 | 4/2002 |
| JP | 2010-000776 | 1/2010 |

* cited by examiner

*Primary Examiner* — Julian Huffman
*Assistant Examiner* — Sharon A Polk
(74) *Attorney, Agent, or Firm* — Cooper & Dunham LLP

(57) ABSTRACT

An inkjet recording apparatus includes a plurality of liquid jet heads each including a plurality of nozzles, a designating unit, and a spitting control unit. The designating unit is configured to designate, among the plurality of nozzles of each of the plurality of liquid jet heads, nozzles involved in printing from data representing an image to be printed as nozzles to be fired for a spitting operation. The spitting control unit is configured to carry out control of, if the number of the nozzles designated by the designating unit exceeds a threshold, performing the spitting operation in a time-divided manner that prevents the number of nozzles fired at a same time for the spitting operation from exceeding the threshold.

5 Claims, 11 Drawing Sheets

FIG.8

| | | NOZZLE No. | | | | | | | | | |
|---|---|---|---|---|---|---|---|---|---|---|---|
| | | 1 | 2 | 3 | 4 | 5 | 6 | 7 | ····· | 319 | 320 |
| HEAD 1 | A ROW | H1A1 | H1A2 | H1A3 | H1A4 | H1A5 | H1A6 | H1A7 | ····· | H1A319 | H1A320 |
| | B ROW | H1B1 | H1B2 | H1B3 | H1B4 | H1B5 | H1B6 | H1B7 | ····· | H1B319 | H1B320 |
| | C ROW | H1C1 | H1C2 | H1C3 | H1C4 | H1C5 | H1C6 | H1C7 | ····· | H1C319 | H1C320 |
| | D ROW | H1D1 | H1D2 | H1D3 | H1D4 | H1D5 | H1D6 | H1D7 | ····· | H1D319 | H1D320 |
| HEAD 2 | A ROW | H2A1 | H2A2 | H2A3 | H2A4 | H2A5 | H2A6 | H2A7 | ····· | H2A319 | H2A320 |
| | B ROW | H2B1 | H2B2 | H2B3 | H2B4 | H2B5 | H2B6 | H2B7 | ····· | H2B319 | H2B320 |
| | C ROW | H2C1 | H2C2 | H2C3 | H2C4 | H2C5 | H2C6 | H2C7 | ····· | H2C319 | H2C320 |
| | D ROW | H2D1 | H2D2 | H2D3 | H2D4 | H2D5 | H2D6 | H2D7 | ····· | H2D319 | H2D320 |
| ⋮ | ⋮ | ⋮ | ⋮ | ⋮ | ⋮ | ⋮ | ⋮ | ⋮ | ⋮ | ⋮ | ⋮ |
| HEAD 8 | A ROW | H8A1 | H8A2 | H8A3 | H8A4 | H8A5 | H8A6 | H8A7 | ····· | H8A319 | H8A320 |
| | B ROW | H8B1 | H8B2 | H8B3 | H8B4 | H8B5 | H8B6 | H8B7 | ····· | H8B319 | H8B320 |
| | C ROW | H8C1 | H8C2 | H8C3 | H8C4 | H8C5 | H8C6 | H8C7 | ····· | H8C319 | H8C320 |
| | D ROW | H8D1 | H8D2 | H8D3 | H8D4 | H8D5 | H8D6 | H8D7 | ····· | H8D319 | H8D320 |

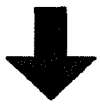

PICK UP AND FIRE NOZZLES OF WHICH NUMBER OF PRINTED DOTS DOES NOT EXCEED PREDETERMINED VALUE FOR SPITTING

| | | NOZZLE No. | | | | | | | | | |
|---|---|---|---|---|---|---|---|---|---|---|---|
| | | 1 | 2 | 3 | 4 | 5 | 6 | 7 | ····· | 319 | 320 |
| HEAD 1 | A ROW | 3 | 3 | 2 | 2 | 2 | 2 | 2 | ····· | 1 | 1 |
| | B ROW | 3 | 3 | 2 | 2 | 2 | 2 | 2 | ····· | 0 | 0 |
| | C ROW | - | - | - | - | - | - | - | ····· | 1 | 1 |
| | D ROW | 2 | 2 | 2 | 2 | 2 | 1 | 1 | ····· | 1 | 0 |
| HEAD 2 | A ROW | 2 | 2 | 1 | 1 | 1 | 1 | 1 | ····· | 2 | 2 |
| | B ROW | 3 | 3 | 2 | 2 | 1 | 1 | 1 | ····· | 1 | 1 |
| | C ROW | - | - | - | 1 | 1 | 1 | 1 | ····· | 0 | 0 |
| | D ROW | 0 | 0 | 0 | 0 | 0 | 0 | 0 | ····· | 0 | 0 |
| ⋮ | ⋮ | ⋮ | ⋮ | ⋮ | ⋮ | ⋮ | ⋮ | ⋮ | ⋮ | ⋮ | ⋮ |
| HEAD 8 | A ROW | 0 | 0 | 0 | 0 | 0 | 0 | 1 | ····· | 2 | 2 |
| | B ROW | 0 | 0 | 0 | 0 | 0 | 1 | 1 | ····· | - | - |
| | C ROW | 0 | 0 | 0 | 2 | 2 | 2 | 2 | ····· | 3 | 3 |
| | D ROW | 0 | 0 | 1 | 1 | 1 | 2 | 2 | ····· | - | - |

PICK UP AND FIRE NOZZLES OF WHICH NUMBER OF PRINTED DOTS DOES NOT EXCEED PREDETERMINED VALUE FOR SPITTING

INKJET RECORDING APPARATUS, CONTROL METHOD FOR INKJET RECORDING APPARATUS, AND NON-TRANSITORY COMPUTER-READABLE MEDIUM

CROSS-REFERENCE TO RELATED APPLICATIONS

The present application claims priority to and incorporates by reference the entire contents of Japanese Patent Application No. 2014-052777 filed in Japan on Mar. 14, 2014.

BACKGROUND OF THE INVENTION

1. Field of the Invention

The present invention relates generally to an inkjet recording apparatus, a control method for inkjet recording apparatus, and a non-transitory computer-readable medium 2. Description of the Related Art Line printers are lower in head drive frequency than serial printers. Accordingly, because the load applied on a head drive circuit of a line printer during printing is low, from the viewpoint of only the load applied during printing, the drive circuit can be reduced in size and cost. However, if a line printer performs spitting to clear nozzles for maintenance purpose in a manner similar to that in a serial printer, a large load is applied. For this reason, unless the load of spitting is reduced, reduction in size and cost of the drive circuit cannot be achieved. It is known that a technique has been devised to overcome this challenge. In this technique, nozzles necessary for spitting are determined from image data received for printing. Electric power consumption necessary for the spitting is calculated and, if the power consumption is higher than a preset value, the ratio of the number of nozzles to be fired for the spitting to a total number of nozzles is adjusted to a value at which the power consumption does not exceed the preset value. An example of this technique is disclosed in Japanese Laid-open Patent Application No. 2002-113847.

The conventional configuration which adjusts the ratio of the number of nozzles to be fired for spitting so that the power consumption does not exceed the preset value can reduce the maximum power consumption. However, the configuration is disadvantageous in that even nozzles to be used in printing can be excluded from the nozzles to be fired for spitting.

Therefore, it is desirable to provide an inkjet recording apparatuses capable of reducing maximum power consumption while performing spitting of nozzles to be used in printing appropriately

SUMMARY OF THE INVENTION

It is an object of the present invention to at least partially solve the problems in the conventional technology.

According to an aspect of the present invention, there is provided an inkjet recording apparatus including: a plurality of liquid jet heads, each of the liquid jet heads including a plurality of nozzles; a designating unit configured to designate, among the plurality of nozzles of each of the plurality of liquid jet heads, nozzles involved in printing from data representing an image to be printed as nozzles to be fired for a spitting operation; and a spitting control unit configured to carry out control of, if the number of the nozzles designated by the designating unit exceeds a threshold, performing the spitting operation in a time-divided manner that prevents the number of nozzles fired at a same time for the spitting operation from exceeding the threshold.

According to another aspect of the present invention, there is provided a control method for inkjet recording apparatus including a plurality of liquid jet heads, each of the liquid jet heads including a plurality of nozzles, the control method including: designating, among the plurality of nozzles of each of the plurality of liquid jet heads, nozzles involved in printing from data representing an image to be printed as nozzles to be fired for a spitting operation; and carrying out spitting control of, if the number of the nozzles designated at the designating exceeds a threshold, performing the spitting operation in a time-divided manner that prevents the number of nozzles fired at a same time for the spitting operation from exceeding the threshold.

According to still another aspect of the present invention, there is provided a non-transitory computer-readable medium having computer readable program codes, performed by an inkjet recording apparatus that includes a plurality of liquid jet heads, each of the liquid jet heads including a plurality of nozzles, the program codes when executed causing the inkjet recording apparatus to execute: designating, among the plurality of nozzles of each of the plurality of liquid jet heads, nozzles involved in printing from data representing an image to be printed as nozzles to be fired for a spitting operation; and carrying out spitting control of, if the number of the nozzles designated at the designating exceeds a threshold, performing the spitting operation in a time-divided manner that prevents the number of nozzles fired at a same time for the spitting operation from exceeding the threshold.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 8 is an explanatory diagram of a method for determining nozzles to be fired for inter-page spitting;

DETAILED DESCRIPTION OF THE PREFERRED EMBODIMENTS

Exemplary embodiments of the present invention are described in detail below with reference to the accompanying drawings.

First Embodiment

Figure 1:
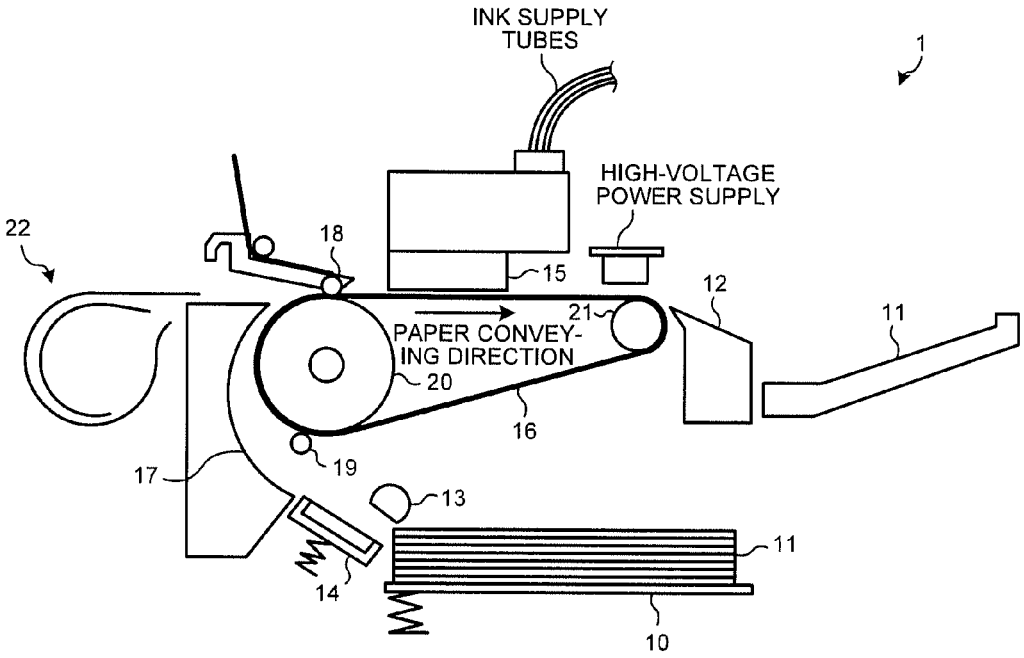
FIG. 1 is a diagram illustrating an overall configuration of an inkjet recording apparatus according to a first embodiment.

FIG. 1 is a diagram illustrating an overall configuration of an inkjet recording apparatus 1 according to a first embodiment. The inkjet recording apparatus 1 is a line printer configured to perform printing on a recording paper (an example of a recording medium) conveyed thereto using ink heads (droplet jet heads; hereinafter, sometimes referred to as "heads") stationarily arranged on a single line across the width of a print area. Each of the plurality of heads provided in the inkjet recording apparatus 1 includes a plurality of nozzles through which droplets are to be ejected.

The inkjet recording apparatus 1 includes an apparatus body, a paper feeding tray 10, which is mounted on the apparatus body and on which sheets of paper (an example of the recording medium) are to be loaded, and a paper ejection tray 11, which is mounted on the apparatus body and on which sheets of paper where images are recorded (formed) are to be stacked. The inkjet recording apparatus 1 further includes a cartridge holding unit 12 on one end of the front surface of the apparatus body. The cartridge holding unit 12 projects forward from the front surface to be lower than the top surface of the apparatus body. An operating unit including an operation key(s) and a display is arranged on the top surface of the cartridge holding unit 12.

The inkjet recording apparatus 1 includes a paper feeding unit for feeding the sheets of paper placed on a sheet table (support plate) of the paper feeding tray 10. The paper feeding unit includes a half-moon-shaped roller (paper feeding roller) 13 for separating and feeding the sheets one sheet by one sheet from the sheet table and a separation pad 14 facing the paper feeding roller 13. The separation pad 14 is made from a material having a high frictional coefficient. The separation pad 14 is urged toward the paper feeding roller 13.

The inkjet recording apparatus 1 includes a conveying unit for conveying the sheet fed from the paper feeding unit at a portion below heads 15. The conveying unit includes a conveying belt 16, a counter roller, a conveyance guide 17, and a leading-end pressing roller 18. The conveying belt 16 conveys the sheet by electrostatically causing the sheet to adhere to the conveying belt 16. The counter roller conveys the sheet delivered from the paper feeding unit via the guide by pinching the sheet between the counter roller and the conveying belt 16. The conveyance guide 17 turns the orientation of the sheet delivered substantially vertically upward by substantially 90 degrees so that the sheet conforms to the conveying belt 16. The leading-end pressing roller 18 is urged toward the conveying belt 16 by a pressing member. The inkjet recording apparatus 1 further includes a charging roller 19 which is a charging unit for charging the surface of the conveying belt.

The conveying belt 16 is an endless belt laid across and around a conveying roller 20 and a tension roller 21 in a tensioned manner and configured to revolve in a belt conveying direction. The charging roller 19 is arranged in contact with the surface layer of the conveying belt 16 so as to be rotated by revolving motion of the conveying belt 16. Approximately 2.5 N, for example, is applied on each end of the charging roller 19 as a pressure. A guide member is arranged on the backside of the conveying belt 16 in an area corresponding to a print area of the head 15. The top surface of the guide member projects toward the head 15 than the tangent between the two rollers (the conveying roller 20 and the tension roller 21) supporting the conveying belt 16. Because the conveying belt 16 is guided by the guide member in a manner of being pushed up by the top surface of the guide member in the print area, accurate flatness of the conveying belt 16 is maintained in the print area.

A plurality of grooves extending in the main scanning direction or, in other words, the direction perpendicular to the conveying direction, are defined in the face of the guide member on the side where the guide member faces the backside of the conveying belt 16. The grooves reduce contact area between the guide member and the conveying belt 16, thereby allowing the conveying belt 16 to move smoothly along the surface of the guide member. The inkjet recording apparatus 1 further includes a paper ejection unit for ejecting a sheet on which an image is recorded by the head 15 and the paper ejection tray 11. The paper ejection unit includes a separation claw for separating the sheet from the conveying belt 16, and a first paper-ejection roller and a second paper-ejection roller. The paper ejection tray 11 is positioned below the first paper-ejection roller. The vertical clearance between the paper ejection tray 11, and the first paper-ejection roller and the second paper-ejection roller is set to a rather high value so that a large number of sheets can be stacked on the paper ejection tray 11. A duplex-printing paper-feeding unit 22 is detachably attached to the back surface of the apparatus body. The duplex-printing paper-feeding unit 22 receives a sheet delivered by reverse revolving of the conveying belt 16, turns the sheet upside down, and feeds back the sheet to between the counter roller and the conveying belt 16. The top surface of the duplex-printing paper-feeding unit 22 is configured as a manual paper-feeding unit.

Figure 2:
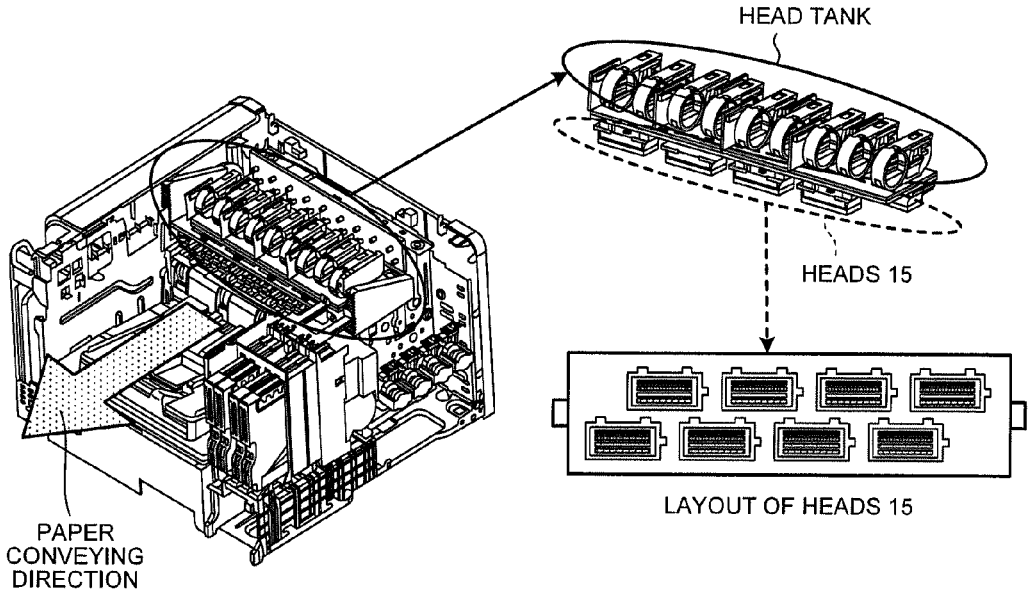
FIG. 2 is a diagram illustrating an example layout of heads of a line printer.

In a line printer, the plurality of heads 15 are arranged in the main-scanning direction as illustrated in FIG. 2. In a serial printer where the number of the heads 15 is one, printing is performed by moving the head 15 in the main-scanning direction. By contrast, in a line printer, printing is performed by ejecting ink from the plurality of heads 15 stationarily arranged in the main-scanning direction at predetermined positions. In a serial printer, the one head 15 prints an entire print area. By contrast, in a line printer, a print area of each of the heads 15 is narrow as compared with that of the serial printer and, accordingly, drive frequency of the heads 15 is low.

Figure 3:
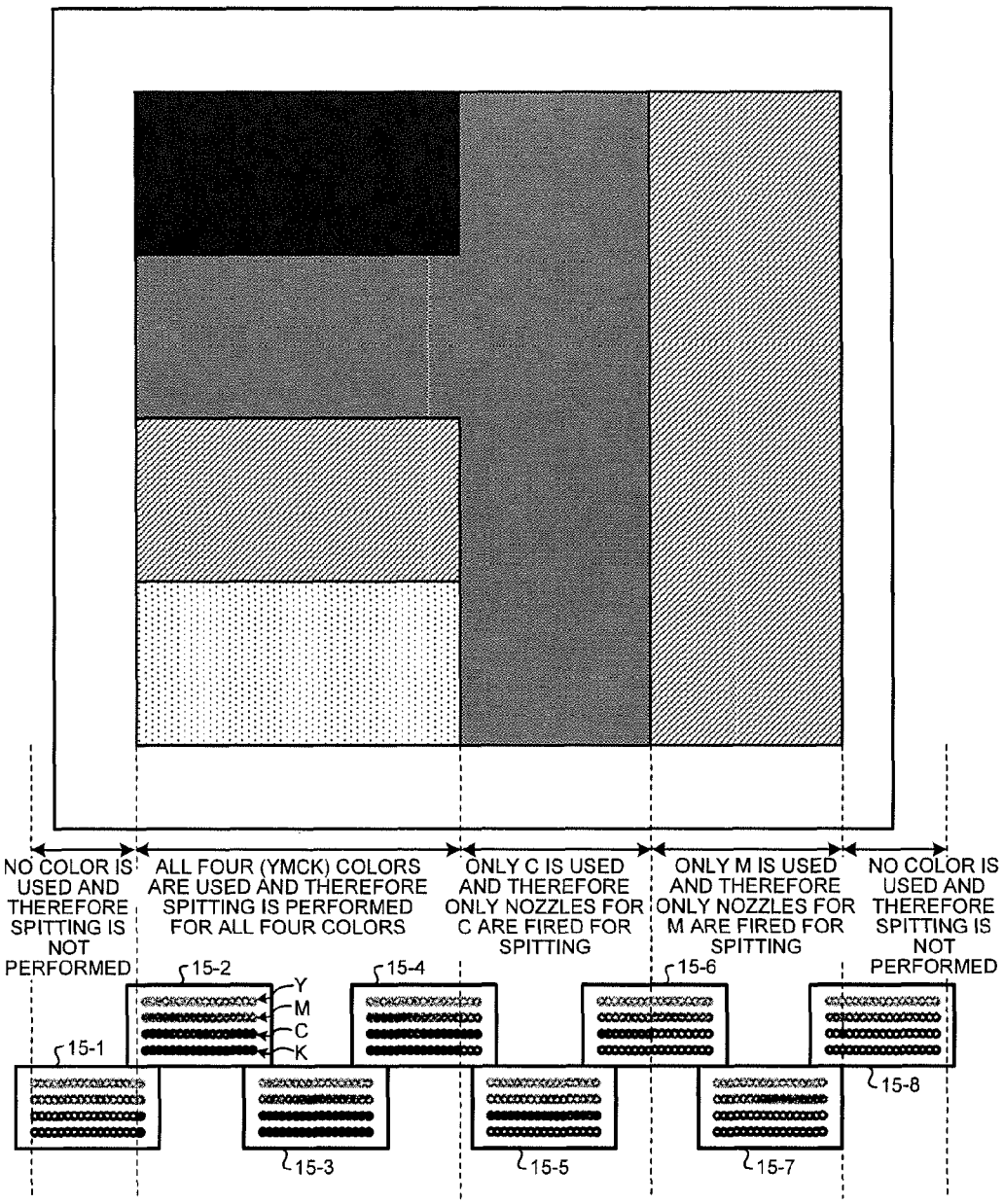
FIG. 3 is a diagram illustrating relative positions between an image to be printed and nozzles to be fired for spitting.

FIG. 3 is a schematic diagram illustrating relative positions of an image to be printed and nozzles to be fired for spitting. In the example illustrated in FIG. 3, the heads 15 arranged in the main-scanning direction are denoted as follows. The first (most left) one of the heads 15 is denoted by 15-1, the second (second left) one is denoted by 15-2, the third (third left) one is denoted by 15-3, . . . . Each head may be simply referred to as the "head 15" without discrimination. Although the number of the heads 15 is eight in the example illustrated in FIG. 3, the number of the heads 15 included in the inkjet recording apparatus 1 is not limited thereto.

In the example illustrated in FIG. 3, each of the heads 15 includes four (Y (yellow), M (magenta), C (cyan), and K (black)) rows of nozzles that are indicated by circles. Nozzles to be fired for spitting are indicated by solid circles. Printing such an image as that illustrated in FIG. 3 does not always require that all the nozzles be fired for spitting. This is because nozzles, among the nozzles in the head 15, used in printing vary depending on the position of the head 15. More specifically, while all the nozzles in one of the heads 15 may be used in printing, only nozzles for one color or only one nozzle per color may be used in another one of the heads 15. Therefore, in the first embodiment, control is carried out as follows. Whether or not each nozzle is necessary for printing (in other words, whether or not the nozzle is involved in printing) is determined from image data (data representing an image to be printed) contained in print data (print job) transmitted from an external entity. Only nozzles involved in printing are designated as nozzles to be fired for spitting, and only the designated nozzles are fired for spitting.

Figure 4:
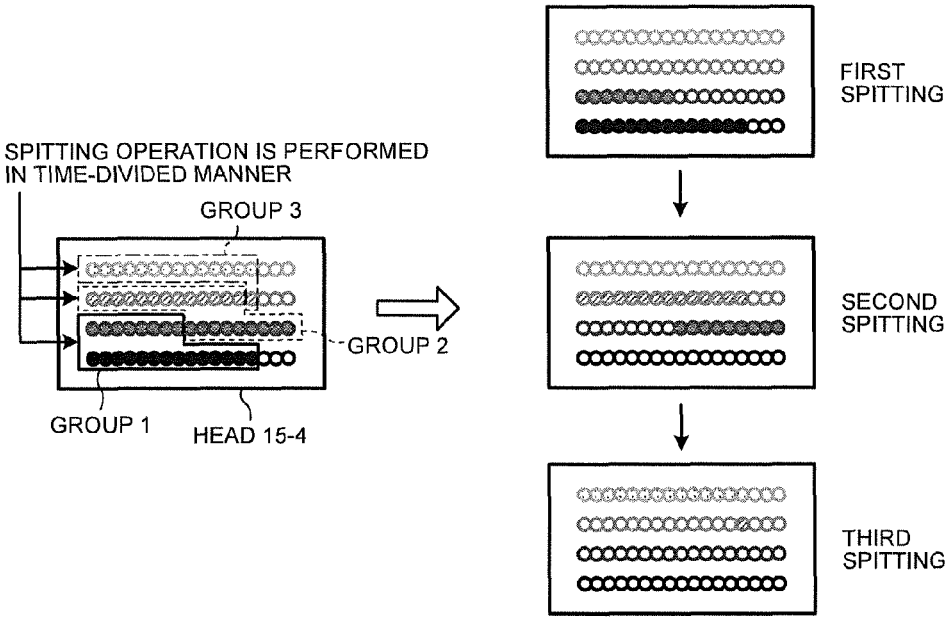
FIG. 4 is an explanatory diagram of a method for performing spitting in a time-divided manner.

FIG. 4 is a diagram schematically illustrating a method for performing spitting in a time-divided manner using an example of the fourth head 15-4 illustrated in FIG. 3. Referring to FIG. 4, the method is performed as follows. A threshold indicating the number of nozzles that can be fired at a same time for spitting is set in advance. When the number of nozzles to be fired for a spitting operation exceeds the threshold, the spitting operation is performed in a time-divided manner so that the number of nozzles fired at a same time for the spitting operation does not exceed the threshold. Illustrated in FIG. 4 is an example of how spitting is performed in a situation where the threshold is "22", and the number of nozzles to be fired for a spitting operation is 59. In this example, the 59 nozzles to be fired for the spitting operation are divided into three groups (Group 1: 22 nozzles, Group 2: 22 nozzles, Group 3: 15 nozzles). Firstly, the 22 nozzles belonging to Group 1 are fired for spitting simultaneously. Secondly, the 22 nozzles belonging to Group 2 are fired for spitting simultaneously. Lastly, the 15 nozzles belonging to Group 3 are fired for spitting simultaneously. The spitting operation is performed in the time-divided manner as described above so that the number of nozzles to be fired simultaneously for the spitting operation does not exceed 22. This control allows reducing maximum power consumption of a head drive circuit (head driver).

Figure 5:
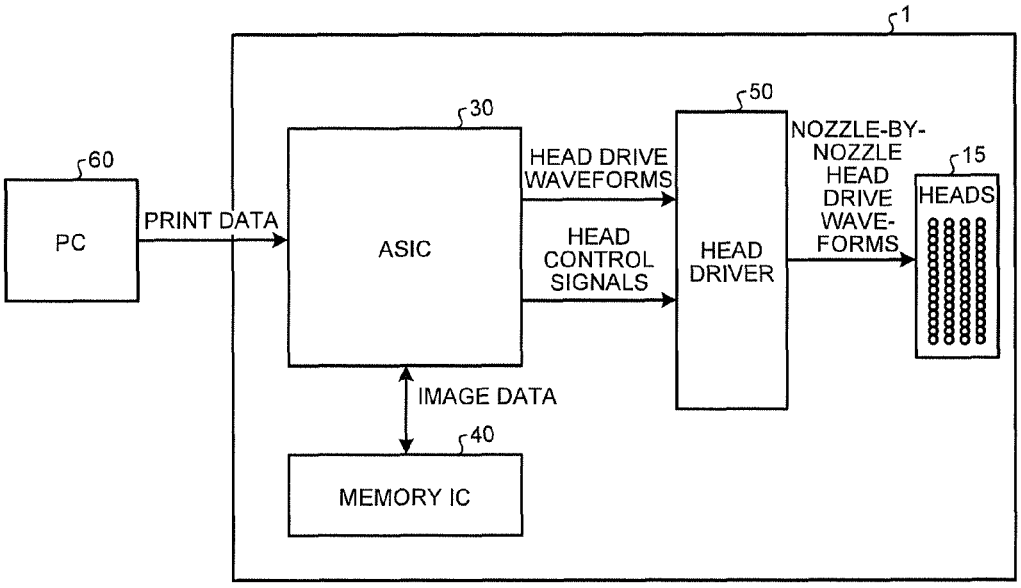
FIG. 5 is a diagram illustrating an example of a system configuration for spitting control.

FIG. 5 is a diagram illustrating an example of a system configuration for spitting control according to the first embodiment. As illustrated in FIG. 5, the inkjet recording apparatus 1 includes an ASIC (application-specific integrated circuit) 30, a memory IC 40, a head driver 50, and the heads 15. Note that in the example illustrated in FIG. 5, features related to embodiments of the present invention are mainly presented as features provided by the inkjet recording apparatus 1. However, features provided by the inkjet recording apparatus 1 are not limited thereto.

First, print data, which is data necessary for printing, is transmitted from an external PC (personal computer) 60 to the inkjet recording apparatus 1, where the ASIC 30 reads the print data. The ASIC 30 stores image data (data representing an image to be printed) contained in the print data transmitted from the PC 60 by writing the image data to the memory IC 40. The ASIC 30 determines, from the image data stored in the memory IC 40, which nozzles of which one(s) of the heads 15 are necessary for printing the image, and designates only nozzles necessary for the printing as nozzles to be fired for a spitting operation. In this example, the ASIC 30 can be regarded as providing a feature corresponding to "designating unit" in the appended claims. The ASIC 30 carries out control in the following manner. The ASIC 30 determines whether or not the number of the nozzles determined as the nozzles to be fired for the spitting operation exceeds the threshold. If the number of the nozzles determined as the nozzles to be fired for the spitting operation exceeds the threshold, the spitting operation is performed in a time-divided manner so that the number of the nozzles to be fired at a same time for the spitting operation does not exceed the threshold. In this example, the ASIC 30 transmits signals indicating drive waveforms for each nozzle of the heads 15 and head control signals to the head driver 50. The head driver 50 drives the nozzles of the respective heads 15 in accordance with the signals fed from the ASIC 30. In this example, the ASIC 30 can be regarded as providing a feature corresponding to "spitting control unit" in the appended claims.

Meanwhile, each of the feature corresponding to "designating unit" and the feature corresponding to "spitting control unit" may be implemented by a dedicated hardware circuit (e.g., semiconductor integrated circuit) or implemented by software or, further alternatively, may be implemented by a combination of these.

When implementing the features by software, the features may be implemented by a CPU (central processing unit) mounted on the inkjet recording apparatus 1 by executing program instructions stored in a ROM (read only memory) or the like. The program instructions to be executed in the inkjet recording apparatus 1 may be configured to be provided as being recorded in a computer-readable recording medium such as a CD-ROM (compact disk read-only memory), an FD (flexible disk), a CD-R (compact disk recordable), or a DVD (digital versatile disk) in an installable or executable format. The program instructions to be executed in the inkjet recording apparatus 1 may be configured to be stored in a computer connected to a network such as the Internet so that the program instructions are provided by downloading over the network. The program instructions to be executed in the inkjet recording apparatus 1 may be configured to be provided or distributed via a network such as the Internet.

Figure 6:
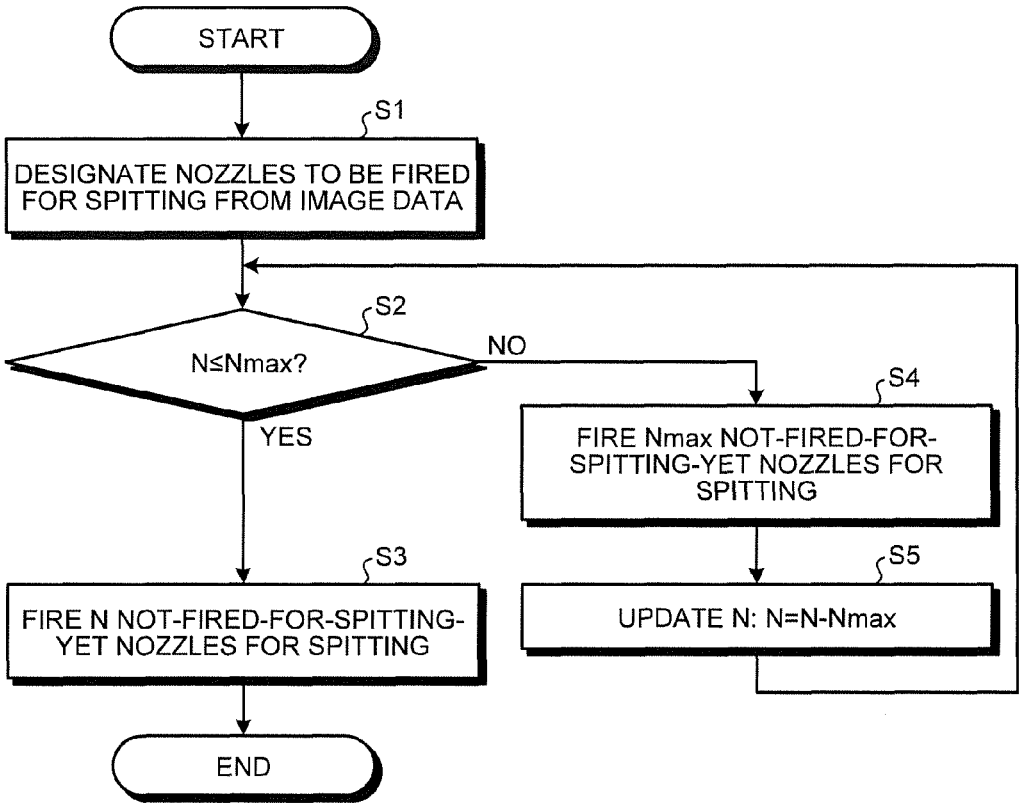
FIG. 6 is a flowchart illustrating an example of the spitting control.

FIG. 6 is a flowchart illustrating an example of the spitting control according to the first embodiment. As described earlier, the ASIC 30 designates, among the nozzles of each of the heads 15, nozzles necessary for printing from data representing an image to be printed as nozzles to be fired for a spitting operation (S1). Thereafter, the ASIC 30 determines whether or not N, which is the number of the nozzles to be fired for the spitting operation, exceeds a threshold Nmax, which indicates the maximum number of nozzles that can be fired at a same time for spitting (S2). If the number N of the nozzles to be fired for the spitting operation designated at S1 is equal to or smaller than the threshold Nmax (Yes at S2), the ASIC 30 carries out control of firing the N nozzles, which are not fired for the spitting operation yet, for the spitting operation (S3). If, on the other hand, the number N of the nozzles to be fired for the spitting operation designated at S1 exceeds the threshold Nmax (No at S2), the ASIC 30 carries out control of firing Nmax nozzles of the nozzles, which are not fired for the spitting operation yet, for the spitting operation (S4). The ASIC 30 updates the number N to a value obtained by subtracting the threshold Nmax from the number N of the nozzles to be fired for the spitting operation at that point in time (S5), and repeats S2 and the following steps.

As described above, in the first embodiment, control is carried out in the following manner. Among the nozzles of each of the heads 15, nozzles involved in printing are designated as nozzles to be fired for a spitting operation from data representing an image to be printed. If the number of the designated nozzles exceeds a threshold, the spitting operation is performed in a time-divided manner so that the number of nozzles fired at a same time for the spitting operation does not exceed the threshold. Consequently, an advantageous effect of reducing maximum power consumption of the head driver 50 while performing spitting of nozzles to be used in printing appropriately can be achieved.

Second Embodiment

Figure 7:
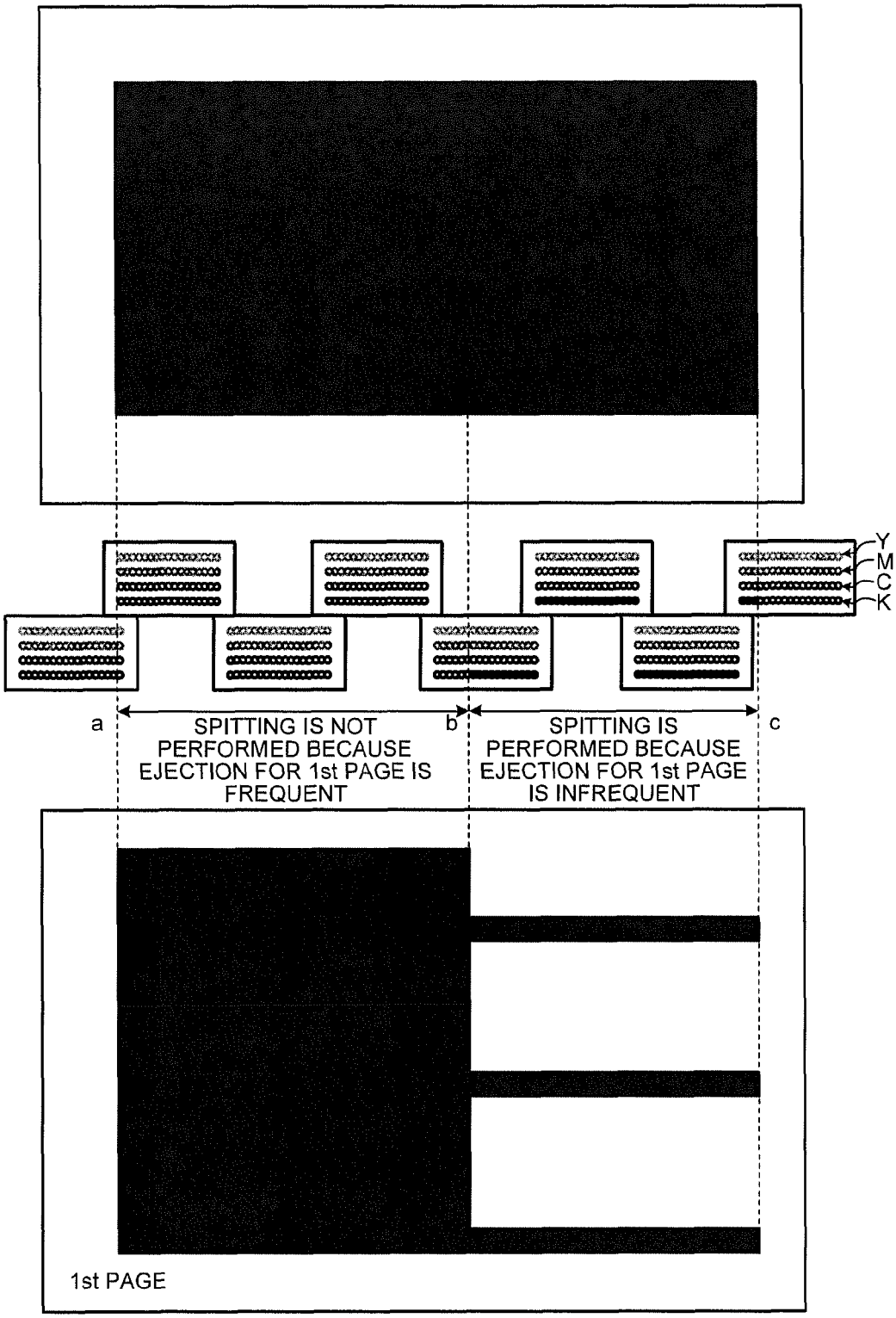
FIG. 7 is a diagram illustrating a method for reducing the number of nozzles to be fired for inter-page spitting when a plurality of pages are to be printed.

In the inkjet recording apparatus 1 according to a second embodiment, when a plurality of pages are to be printed, nozzles to be fired for inter-page spitting (spitting between one page (hereinafter, sometimes referred to as "preceding page") and a next page following the one page) are designated based on nozzle usage frequency in the one page. This will be described in more detail below. FIG. 7 is a diagram illustrating a method for reducing the number of nozzles to be fired for inter-page spitting when a plurality of pages are to be printed. In FIG. 7, the nozzles to be fired for spitting are indicated by solid circles. Referring to the example illustrated in FIG. 7, all the nozzles for K (black) in the a-c area are to be used in printing the image of the second page. However, the nozzles for K in the a-b area are highly frequently used in printing of the first page. For this reason, control is carried out in the following manner. The nozzles in the a-b area are not fired for inter-page spitting, but only the nozzles in the b-c area used with low frequency in printing of the first page are fired for spitting. Carrying out control in this manner allows further reduction in the number of nozzles to be fired for spitting.

FIG. 8 is an explanatory diagram of a method for determining nozzles to be fired for inter-page spitting between one page and a next page following the one page. When a plurality of pages are to be printed, the ASIC 30 counts the numbers of dots printed in the one page on a per-nozzle basis of each of the heads 15 from data representing an image to be printed, and stores the counted numbers in a memory (not shown) as in the table illustrated in FIG. 8. The ASIC 30 compares the counted numbers against a predetermined value on the per-nozzle basis. If a counted number of a nozzle is smaller than the predetermined value, the ASIC 30 designates the nozzle as a nozzle to be fired for inter-page spitting.

Third Embodiment

The inkjet recording apparatus 1 according to a third embodiment further includes a feature for configuring whether or not to reduce the number of nozzles to be fired for inter-page spitting. This feature corresponds to "first configuring unit" in the appended claims. In the example described below, this feature is provided by the ASIC 30, but not limited thereto.

Figure 9:
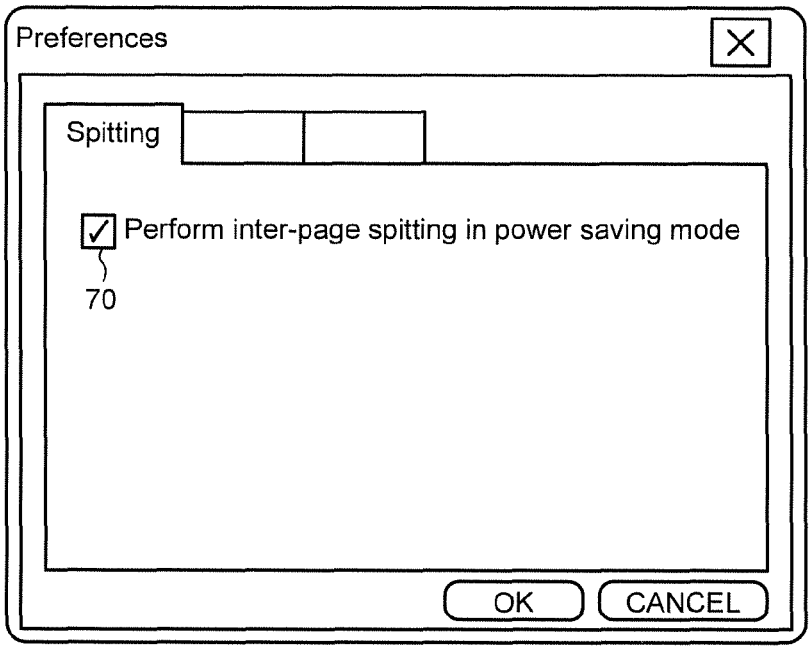
FIG. 9 is an explanatory diagram of a feature for configuring whether or not to reduce the number of nozzles to be fired for inter-page spitting.

According to the third embodiment, as illustrated in FIG. 9, a menu option for configuring whether or not to reduce the number of nozzles to be fired for inter-page spitting is provided on the printer driver. If a user places a checkmark in a checkbox 70 provided on the printer driver for selecting whether or not to reduce the number of nozzles to be fired for inter-page spitting as illustrated in FIG. 9, the inkjet recording apparatus 1 (more specifically, the ASIC 30) carries out control of reducing the number of nozzles to be fired for inter-page spitting. On the other hand, if the user does not place a checkmark in the checkbox 70, the inkjet recording apparatus 1 does not carry out control of reducing the number of nozzles to be fired for inter-page spitting, but designates (sets) all the nozzles to be used in printing of a next page as nozzles to be fired for spitting.

Modification of Third Embodiment

Figure 10:
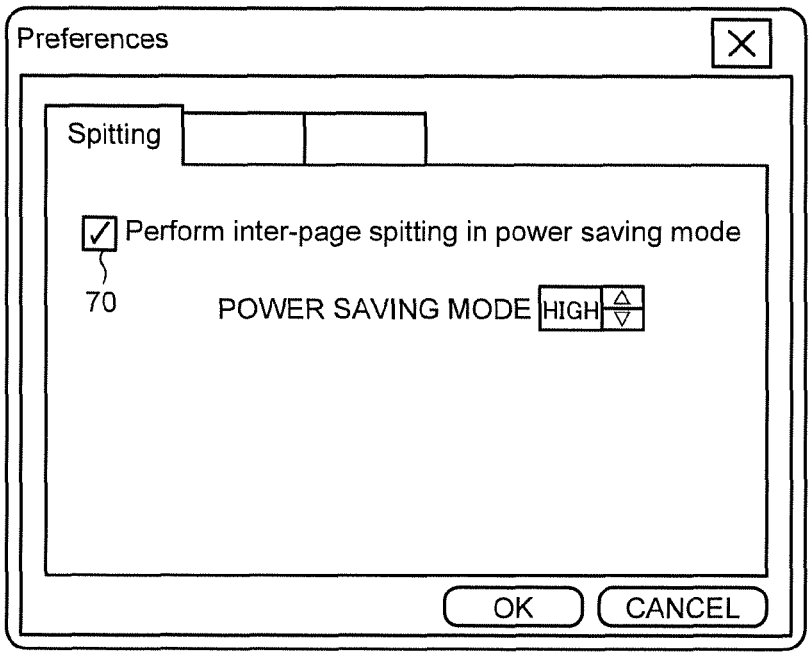
FIG. 10 is an explanatory diagram of a feature for selecting a level of magnitude of reduction in the number of nozzles is to be reduced.

The inkjet recording apparatus 1 (more specifically, the ASIC 30) of the third embodiment may be modified to be capable of configuring, when the number of the nozzles to be fired for inter-page spitting is to be reduced, a magnitude of reduction in the number of the nozzles, for example. As illustrated in FIG. 10, a menu option for selecting, when a user has selected to reduce the number of nozzles to be fired for inter-page spitting (i.e., when a checkmark is placed in the checkbox 70), a level indicating a magnitude of reduction in the number of the nozzles may be provided on the printer driver. Assume that, for example, the level of the reduction magnitude is selectable from three levels of "high", "medium", and "low". When "high" is selected, the above-described predetermined value against which the counted value of each of the nozzles is to be compared can be set to "100", so that nozzles the counted number (the number of dots printed in a preceding page) of which does not exceed 100 can be designated as nozzles to be fired for inter-page spitting. Similarly, when "medium" is selected, the above-described predetermined value can be set to "300", so that nozzles the counted number (the number of dots printed in the preceding page) of which does not exceed 300 can be designated as nozzles to be fired for inter-page spitting. Similarly, when "low" is selected, the above-described predetermined value can be set to "500", so that nozzles the counted number (the number of dots printed in the preceding page) of which does not exceed 500 can be designated as nozzles to be fired for inter-page spitting.

Fourth Embodiment

Figure 11:
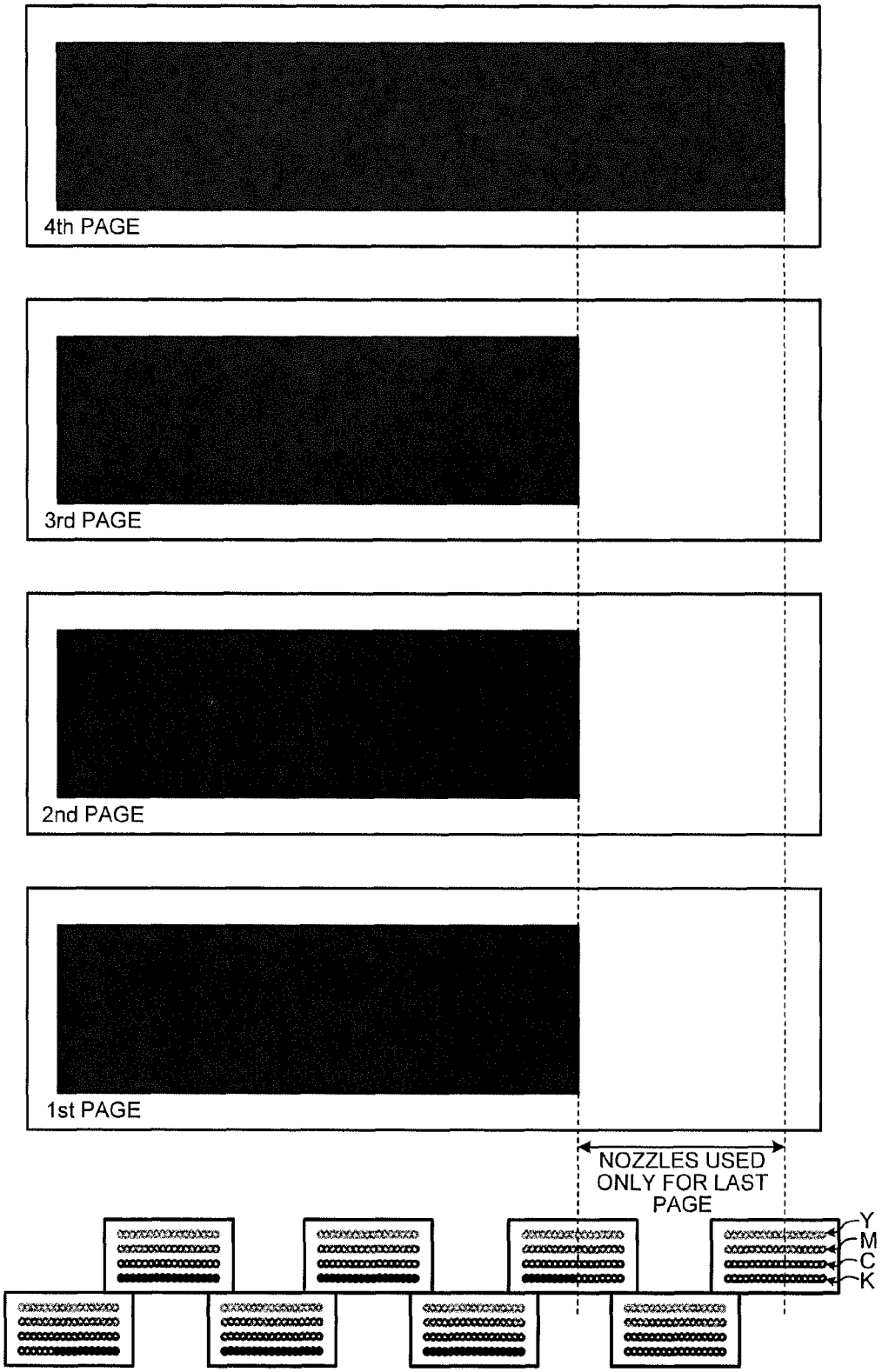
FIG. 11 is an explanatory diagram of a situation where, when a plurality of pages are to be printed, there are nozzles used only for the last page.

In the inkjet recording apparatus 1 according to a fourth embodiment, when a plurality of pages are to be printed, the ASIC 30 carries out control in the following manner. Nozzles having not been fired for spitting throughout a preset number of consecutive pages from print start are designated as nozzles to be fired for compulsory spitting, and the designated nozzles are fired for compulsory spitting. FIG. 11 is an explanatory diagram of a situation in which, when a plurality of pages are to be printed, there are nozzles used only for the last page (in the example illustrated in FIG. 11, the fourth page). Illustrated in FIG. 11 is an example where four pages are to be printed, and there are nozzles used only for the fourth page. The nozzles to be used only for the fourth page are fired for spitting only in a gap between the third page and the fourth page, which is immediately before when the fourth page is printed. Accordingly, the long interval between print start and the spitting can increase the possibility that ejection (ejection of ink) is not performed normally. Against this backdrop, in the fourth embodiment, control is carried out to compulsorily fire nozzles having not been fired for spitting throughout a preset number of consecutive pages from print start for spitting.

Figure 12:
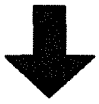
FIG. 12 is an explanatory diagram of a method for determining nozzles to be fired for compulsory spitting.

FIG. 12 is an explanatory diagram of a method for determining nozzles to be fired for compulsory spitting. The ASIC 30 counts the numbers of consecutive pages throughout which no spitting is performed for each of the nozzles on a per-head basis, and records the counted numbers in the memory (not shown) as illustrated in FIG. 12. Note that counting is not performed (indicated by "-" in FIG. 12) for nozzles that are not used even once in the target print job (i.e. nozzles not involved in printing). The ASIC 30 carries out control in the following manner. The counted numbers are compared against a preset value (which indicates the preset number) on the per-nozzle basis and, if a counted number of a nozzle is larger than the value indicating the preset number, the nozzle is designated as a nozzle to be fired for compulsory spitting. Nozzles designated in this manner are fired for compulsory spitting.

Modification of Fourth Embodiment

The inkjet recording apparatus 1 according to the fourth embodiment may be modified to further include a feature for configuring the value indicating the preset number changeable. This feature corresponds to "second configuring unit" in the appended claims. In the example described below, this feature is provided by the ASIC 30, but not limited thereto.

Figure 13:
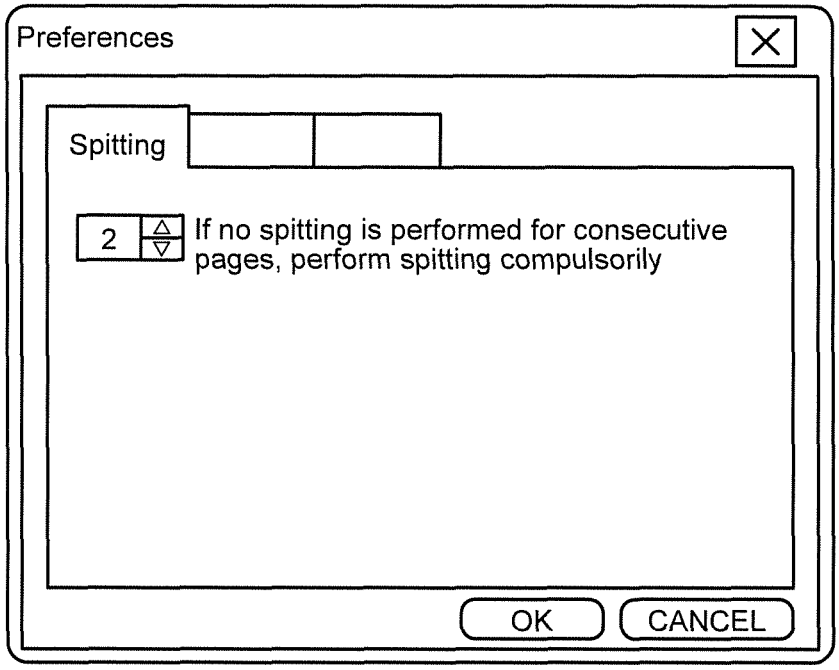
FIG. 13 is an explanatory diagram of a feature for configuring frequency of compulsory spitting.

For example, as illustrated in FIG. 13, a menu option for configuring how often compulsory spitting is to be performed (more specifically, for changing the value indicating the preset number) may be provided on the printer driver. This configuration allows a user to configure the number of consecutive pages throughout which no spitting is performed as a condition for performing compulsory spitting, thereby allowing the user to configure how often compulsory spitting is to be performed.

Fifth Embodiment

Figure 14:
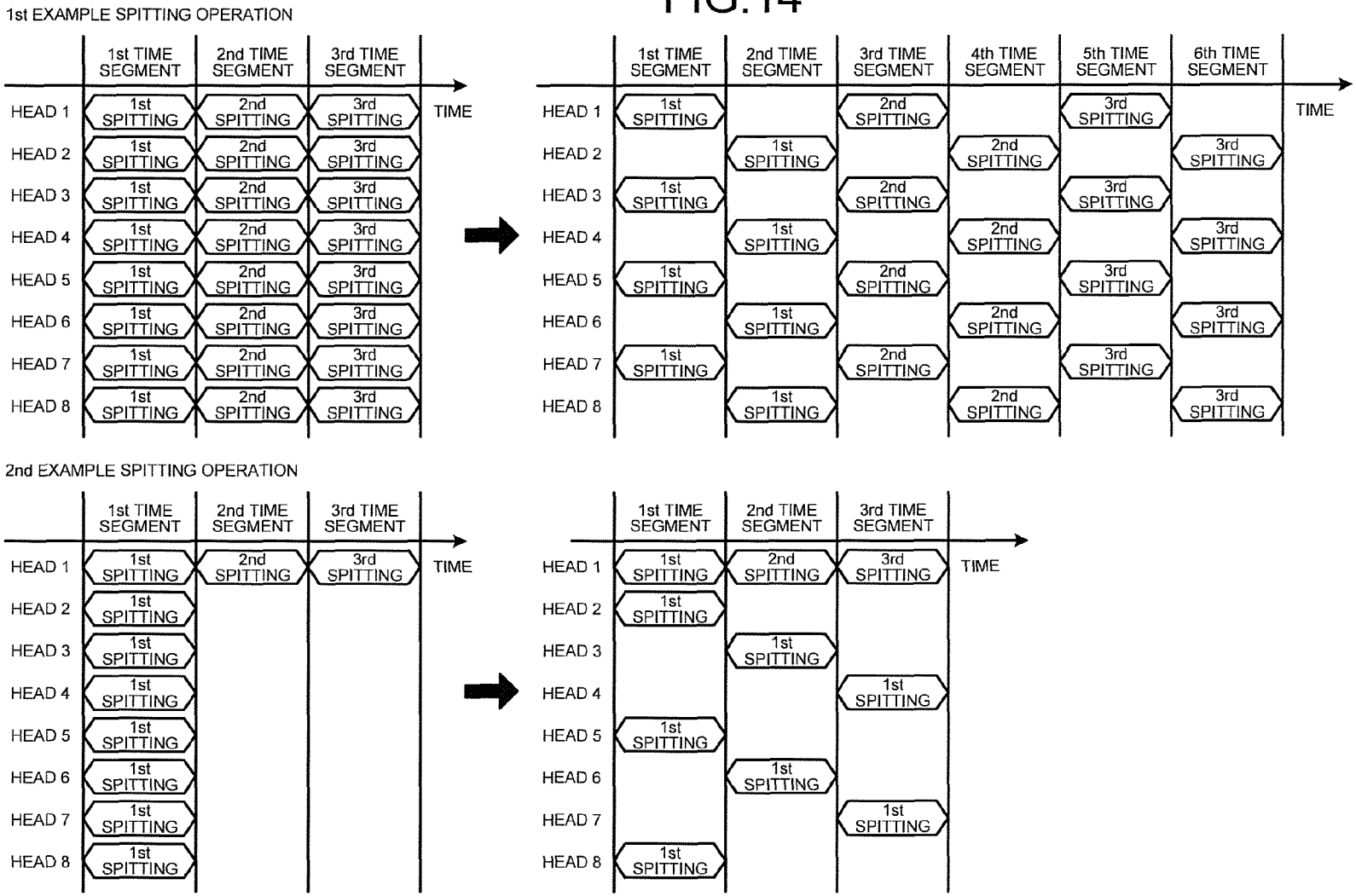
FIG. 14 is a diagram illustrating an example of head-by-head spitting timing control.

In the inkjet recording apparatus 1 according to a fifth embodiment, the ASIC 30 provides head-by-head spitting timing control on the heads 15 so that the number of the heads 15 performing spitting at a same time does not exceed a predefined value. FIG. 14 is a diagram illustrating an example of the head-by-head spitting timing control provided on the heads 15. Assume a situation where each of a first example spitting operation and a second example spitting operation illustrated in FIG. 14 is divided as indicated on the left side of the arrows of FIG. 14. When spitting is performed as indicated on the left side of the arrows of FIG. 14, all the heads 15 can be fired for spitting in one time segment. In that case, load placed on power supply increases. In consideration of this, according to the fifth embodiment, a maximum number of the heads 15 that can be fired for spitting in one time segment is defined in advance. The ASIC 30 provides timing control on spitting of each of the heads 15 so that the number of the heads 15 fired for spitting in one time segment does not exceed the predefined number. For instance, when the maximum number of the heads 15 that can be fired for spitting in one time segment is set to "4", the maximum load placed on the power supply can be reduced by distributing spitting timing as indicated on the right side of the arrows of FIG. 14.

According to an aspect of the present invention, reduction in maximum power consumption can be achieved while performing spitting of nozzles to be used in printing appropriately.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An inkjet recording apparatus comprising:

a plurality of liquid jet heads, each of the liquid jet heads including a plurality of nozzles;

a designating unit configured to designate, among the plurality of nozzles of each of the plurality of liquid jet heads, nozzles involved in printing from data representing an image to be printed as nozzles to be fired for a spitting operation;

a spitting control unit configured to carry out control of, if the number of the nozzles designated by the designating unit exceeds a threshold, performing the spitting operation in a time-divided manner that prevents the number of nozzles fired at a same time for the spitting operation from exceeding the threshold, wherein when a plurality of pages are to be printed, the designating unit designates, among the plurality of nozzles, nozzles to be fired for inter-page spitting between one page and a next page following the one page based on usage frequency of the plurality of nozzles in the one page; and a first configuring unit configured to configure whether or not to reduce the number of the nozzles to be fired for inter-page spitting.

2. The inkjet recording apparatus according to claim 1, wherein when the number of the nozzles to be fired for inter-page spitting is to be reduced, the first configuring unit configures a magnitude of reduction in the number of the nozzles.

3. An inkjet recording apparatus comprising:

a plurality of liquid jet heads, each of the liquid jet heads including a plurality of nozzles;

a designating unit configured to designate, among the plurality of nozzles of each of the plurality of liquid jet heads, nozzles involved in printing from data representing an image to be printed as nozzles to be fired for a spitting operation; and a spitting control unit configured to carry out control of, if the number of the nozzles designated by the designating unit exceeds a threshold, performing the spitting operation in a time-divided manner that prevents the number of nozzles fired at a same time for the spitting operation from exceeding the threshold, wherein when a plurality of pages are to be printed, the designating unit designates, among the plurality of nozzles, nozzles having not been fired for spitting throughout a preset number of consecutive pages since print start as nozzles to be fired for compulsory spitting, and the spitting control unit carries out control of firing the nozzles designated as the nozzles to be fired for compulsory spitting by the designating unit for compulsory spitting.

4. The inkjet recording apparatus according to claim 3, further comprising a second configuring unit configured to configure the preset number changeable.

5. An inkjet recording apparatus comprising:

a plurality of liquid jet heads, each of the liquid jet heads including a plurality of nozzles;

a designating unit configured to designate, among the plurality of nozzles of each of the plurality of liquid jet heads, nozzles involved in printing from data representing an image to be printed as nozzles to be fired for a spitting operation; and a spitting control unit configured to carry out control of, if the number of the nozzles designated by the designating unit exceeds a threshold, performing the spitting operation in a time-divided manner that prevents the number of nozzles fired at a same time for the spitting operation from exceeding the threshold, wherein the spitting control unit provides timing control on spitting of each of the liquid jet heads in a manner that prevents the number of liquid jet heads fired for spitting at a same time from exceeding a predefined value.

* * * * *